US005091019A

United States Patent [19]

LaSalle

[11] Patent Number: 5,091,019

[45] Date of Patent: Feb. 25, 1992

[54] RAPIDLY SOLIDIFIED ALUMINUM LITHIUM ALLOYS HAVING ZIRCONIUM

[75] Inventor: Jerry C. LaSalle, Upper Montclair, N.J.

[73] Assignee: Allied-Signal, Inc., Morris Township, Morris County, N.J.

[21] Appl. No.: 478,306

[22] Filed: Feb. 12, 1990

[51] Int. Cl.[5] ..... C22F 1/04

[52] U.S. Cl. ..... 148/11.5 A; 148/403; 420/528

[58] Field of Search ..... 148/11.5 A, 403; 420/528

[56] References Cited

U.S. PATENT DOCUMENTS 4,643,779 2/1987 Abbaschian et al. ..... 148/11.5 A
4,643,780 2/1987 Gilman et al. ..... 148/11.5 A
4,661,172 4/1987 Skinner et al. ..... 148/11.5 A
4,804,423 2/1989 Dubost ..... 148/11.5 A

FOREIGN PATENT DOCUMENTS 2170462 7/1987 Japan ..... 148/11.5 A

*Primary Examiner*—Upendra Roy
*Attorney, Agent, or Firm*—Ernest D. Buff; Gerhard H. Fuchs; Richard C. Stewart

[57] ABSTRACT

A rapidly solidified, low density aluminum base alloy consisting essentially of the formula $Al_{ba1}$-$Li_aCu_bMG_cZr_d$ wherein "a" ranges from about 2.1 to 3.4 wt %, "b" ranges from about 0.5 to 2.0 wt %, "c" ranges from about 0.2 to 2.0 wt % and "d" ranges from about 0.4 to 1.8 wt %, the balance being aluminum is consolidated to produce a strong, tough low density article.

8 Claims, 3 Drawing Sheets

RAPIDLY SOLIDIFIED ALUMINUM LITHIUM ALLOYS HAVING ZIRCONIUM

FIELD OF THE INVENTION

The invention relates to aluminum metal alloys having reduced density. More particularly, the invention relates to aluminum-lithium-zirconium powder metallurgy alloys that are capable of being rapidly solidified into structural components having a combination of high ductility (toughness) and high tensile strength to density ratio (specific strength).

BRIEF DESCRIPTION OF THE PRIOR ART

The need for structural aerospace alloys of improved specific strength and specific modulus has long been recognized. It has been recognized that the elements lithium, beryllium, boron, and magnesium could be added to aluminum alloys to decrease the density. Current methods of production of aluminum alloys, such as direct chill (DC) continuous and semi-continuous casting have produced aluminum alloys having up to 5 wt % magnesium or beryllium but the alloys have generally not been adequate for widespread use in applications requiring a combination of high strength and low density. Lithium contents of about 2.5 wt % have been satisfactorily cast in the lithium-copper-magnesium family of aluminum alloys such as 8090, 8091, 2090, and 2091. These alloys have copper and magnesium additions in the 1 to 3 wt % and 0.25 to 1.5 wt % range, respectively. In addition, zirconium is also added at levels up to 0.16 wt %.

The above alloys derive their good strength and toughness through the formation of several precipitate phases which are described in detail in the Conference Proceedings of Aluminum-Lithium V, edited by T. H. Sanders and E. A. Starke, pub MCE, (1989). An important strengthening precipitate in aluminum-lithium alloys is the metastable δ' phase which has a well defined solvus line. Thus, aluminum-lithium alloys are heat treatable, their strength increasing as δ' homogeneously nucleates from the supersaturated aluminum matrix.

The δ' phase has an ordered $Ll_2$ crystal structure and the composition $Al_3Li$. The phase has a very small lattice misfit with the surrounding aluminum matrix and thus a coherent interface with the matrix. Dislocations easily shear the precipitates during deformation resulting in the buildup of planar slip bands. This, in turn, reduces the toughness of aluminum lithium alloys. In binary aluminum-lithium alloys where this is the only strengthening phase employed, the slip planarity results in reduced toughness.

The addition of copper and magnesium to aluminum-lithium alloys has two beneficial effects. First, the elements reduce the solubility of lithium in aluminum, thus increasing the amount of lithium available for strengthening precipitates. More importantly, however, the copper and magnesium allow the formation of additional precipitate phases, most importantly the orthorhombic S' Phase ($Al_2MgLi$) and the hexagonal $T_1$ phase ($Al_2CuLi$). Unlike δ', these phases are resistant shearing by dislocations and are effective in minimizing slip planarity. The resulting homogeneity of the deformation results in improved toughness, increasing the applicability of these alloys over binary aluminum-lithium. Unfortunately, these phases form sluggishly, precipitating primarily on heterogeneous nucleation sites such as dislocations. In order to generate these nucleation sites, the alloys must be cold worked prior to aging.

Additions of zirconium under approximately 0.15 wt % are typically added to the alloys to form the metastable $Al_3Zr$ phase for grain size control and to retard recrystallization. Metastable $Al_3Zr$ consists of an $Ll_2$ crystal structure which is essentially isostructural with δ' ($Al_3Li$). Additions of zirconium to aluminum beyond 0.15 wt % using conventional casting practice result in the formation of relatively large dispersoids of equilibrium $Al_3Zr$ having the tetragonal $DO_{23}$ structure.

Much work has been done to develop the aforementioned alloys which are currently near commercialization. However, the processing constraint imposed by the need for cold deformation has limited the application of these alloys to thin, low dimensional shapes such as sheet and plate. Complex, shaped components such as forgings are unsuitable to such processing. Consequently, there are currently no conventional aluminum-lithium alloy forgings having desirable combinations of strength, ductility, and low density required in aircraft forgings.

D. J. Skinner, K. Okazaki, and C. M. Adam, U.S. Pat. No. 4,661,172 (1987) have developed a series of aluminum-lithium alloys whereby rapid solidification techniques were employed to produce structural components of alloys containing lithium between 3.5 and 4.0 wt %. These alloys exhibit good strength values but have toughness lower than that considered desirable for use in aircraft forgings.

SUMMARY OF THE INVENTION

The invention provides a low density aluminum-base alloy, consisting essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt %, and "d" ranges from about 0.4 to 1.8 wt %, the balance being aluminum.

The invention also provides a method for producing consolidated article from a low density, aluminum-lithium-zirconium alloy. The method includes the step of compacting together particles composed of a low density aluminum-lithium-zirconium alloy, consisting essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt %, "d" ranges from about 0.4 to 1.8 wt % and the balance is aluminum. The alloy has a primary, cellular dendritic, fine-grained supersaturated aluminum alloy solid solution phase with filamentary, intermetallic phases of the constituent elements uniformly dispersed therein. These intermetallic phases have width dimensions of not more than about 100 nm. The compacted alloy is solutionized by heat treatment at a temperature ranging from about 500° C. to 550° C. for a period of approximately 0.5 to 5 hours, quenched in a fluid bath held at approximately 0°-80° C. and optionally, aged at a temperature ranging from about 100° C. to 250° C. for a period ranging from about 1 to 40 hrs.

The consolidated article of the invention has a distinctive microstructure composed of an aluminum solid solution containing therein a substantially uniform dispersion of intermetallic precipitates. These precipitates are composed essentially of fine intermetallics measuring not more than about 20 nm along the largest linear dimension thereof. In addition, the article of the invention has a density of not more than about 2.6 grams/cm$^3$ an ultimate tensile strength of at least about 500 MPa, an ultimate tensile strain to fracture of about 5% elongation, and a V-notch impact toughness in the L-T direction of at least $4.0\times10^{-2}$ joule/mm$^2$, all measured at room temperature (about 20° C.).

Thus, the invention provides distinctive aluminum-base alloys that are particularly capable of being formed into consolidated articles that have a combination of high strength, toughness and low density. The method of the invention advantageously minimizes coarsening of zirconium rich, intermetallic phases within the alloy to increase the ductility of the consolidated article, and maximized the amount of zirconium held in the aluminum solid solution phase to increase the strength and hardness of the consolidated article. As a result, the article of the invention has an advantageous combination of low density, high strength, high elastic modulus, good ductility, high toughness and thermal stability. Such alloys are particularly useful for lightweight structural parts such as required in automobile, aircraft or spacecraft applications.

BRIEF DESCRIPTION OF THE DRAWINGS

The invention will be more fully understood and further advantages will become apparent when reference is made to the following detailed description of the preferred embodiment of the invention and the accompanying drawings in which:

FIG. 1*b* shows the electron diffraction pattern of the article in FIG. 1*a.

DESCRIPTION OF THE PREFERRED EMBODIMENTS

Figure 1A:
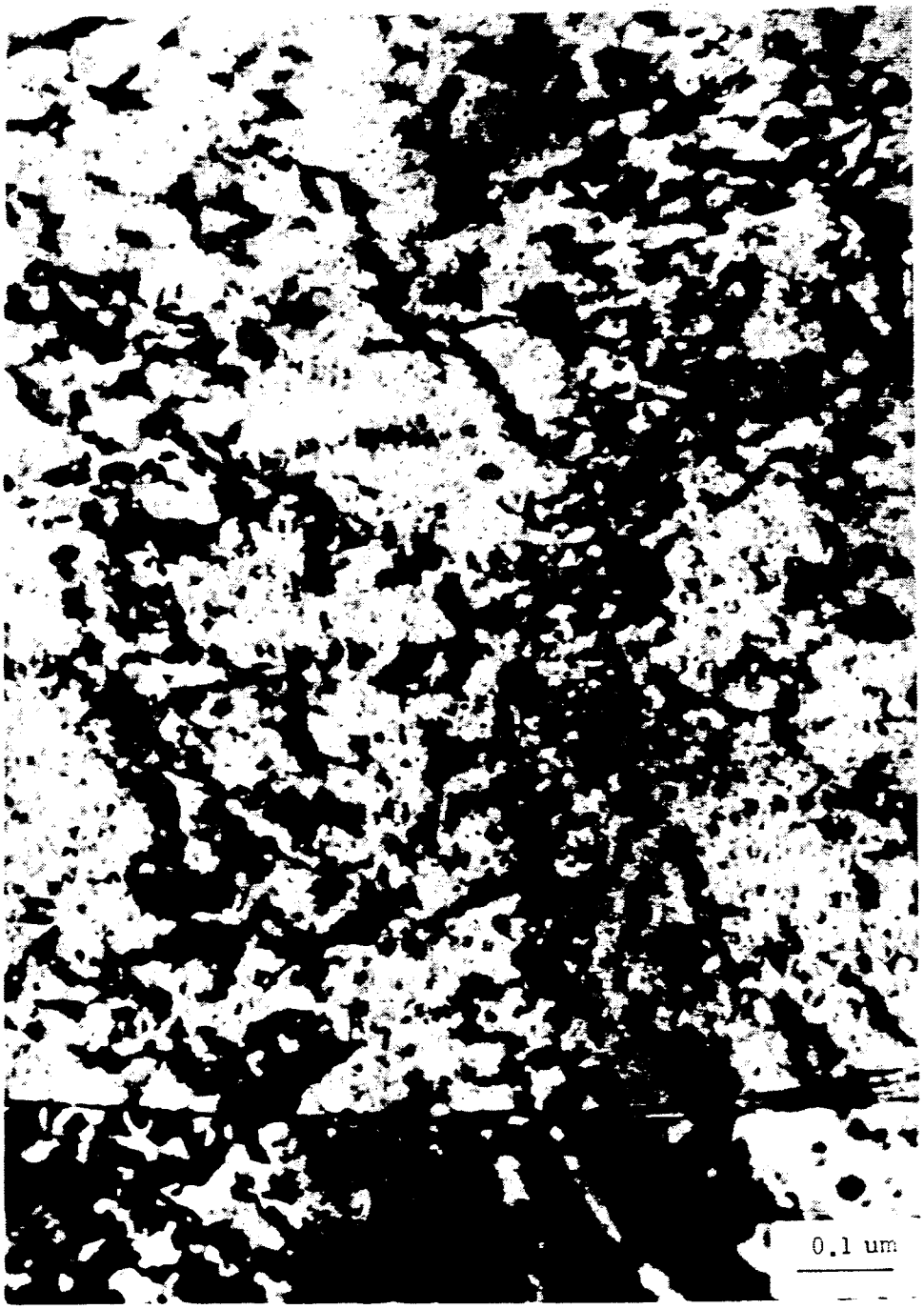
FIG. 1*a* shows a bright field transmission electron micrograph (TEM) of the microstructure of a representative alloy of the invention (Al-2.6Li-1.0Cu-0.5Mg-0.8Zr) which has been formed into a consolidated article by extrusion and has been precipitation hardened by the δ' [$Al_3$(Li,Zr)] phase.

The invention provides a low density aluminum-base alloy, consisting essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt %, "d" ranges from about 0.4 to 1.8 wt % and the balance is aluminum. The alloys contain selected amounts of lithium and magnesium to provide high strength and low density. In addition, the alloys contain secondary elements to provide ductility and fracture toughness. The element copper is employed to provide superior precipitation hardness response. The element zirconium provides two functions. First, it provides grain size control by pinning the grain boundaries during thermomechanical processing. Second, it forms nonshearable $Al_3$(Zr,Li) precipitates which homogenize the dislocation substructure during deformation improving ductility and toughness. Preferred alloys may also contain about 2.7 to 3.0 wt % Li, about 0.8 to 1.2 wt % Cu, 0.3 to 0.8 wt % Mg, and 0.7 to 1.6 wt % Zr. Most preferred alloys may also contain 1.0 to 1.2 wt % Zr.

Alloys of the invention are produced by rapidly quenching and solidifying a melt of a desired composition at a rate of at least about $10^5$ C/sec onto a moving chilled casting surface. The casting surface may be, for example, the peripheral surface of a chill roll. Suitable casting techniques include, for example, jet casting and planar flow casting through a slot-type orifice. Other rapid solidification techniques, such as melt atomization and quenching processes, can also be employed to produce the alloys of the invention in nonstrip form, provided the technique produces a uniform quench rate of at least about $10^5$ C/sec.

Alloys having the above described microstructure are particularly useful for forming consolidated articles employing conventional powder metallurgy techniques, which include direct powder rolling, vacuum hot compaction, blind-die compaction in an extrusion press or forging press, direct and indirect extrusion, impact forging, impact extrusion and combinations of the above. After comminution to suitable particle size of about −60 to 200 mesh, the alloys are compacted in a vacuum of less than about $10^{-4}$ torr ($1.33\times10^{-2}$ Pa) preferably about $10^{-5}$ torr, and at a temperature of not more than about 400° C., preferably about 375° C. to minimize coarsening of the intermetallic, zirconium rich phases.

The compacted alloy is solutionized by heat treatment at a temperature ranging from about 500° C. to 550° C. for a period of approximately 0.5 to 5 hrs. to convert elements, such as Cu, Mg, and Li, from microsegregated and precipitated phases into the aluminum solid solution phase. This solutionizing step also produces an optimized distribution of $Al_3$(Zr,Li) particles ranging from about 10 to 50 nanometers in size. The alloy article is then quenched in a fluid bath, preferably held at approximately 0° to 80° C. The compacted article is aged at a temperature ranging from about 100° C. to 250° C. for a period ranging from about 1 to 40 hrs. to provide selected strength/toughness tempers.

Figure 1B:
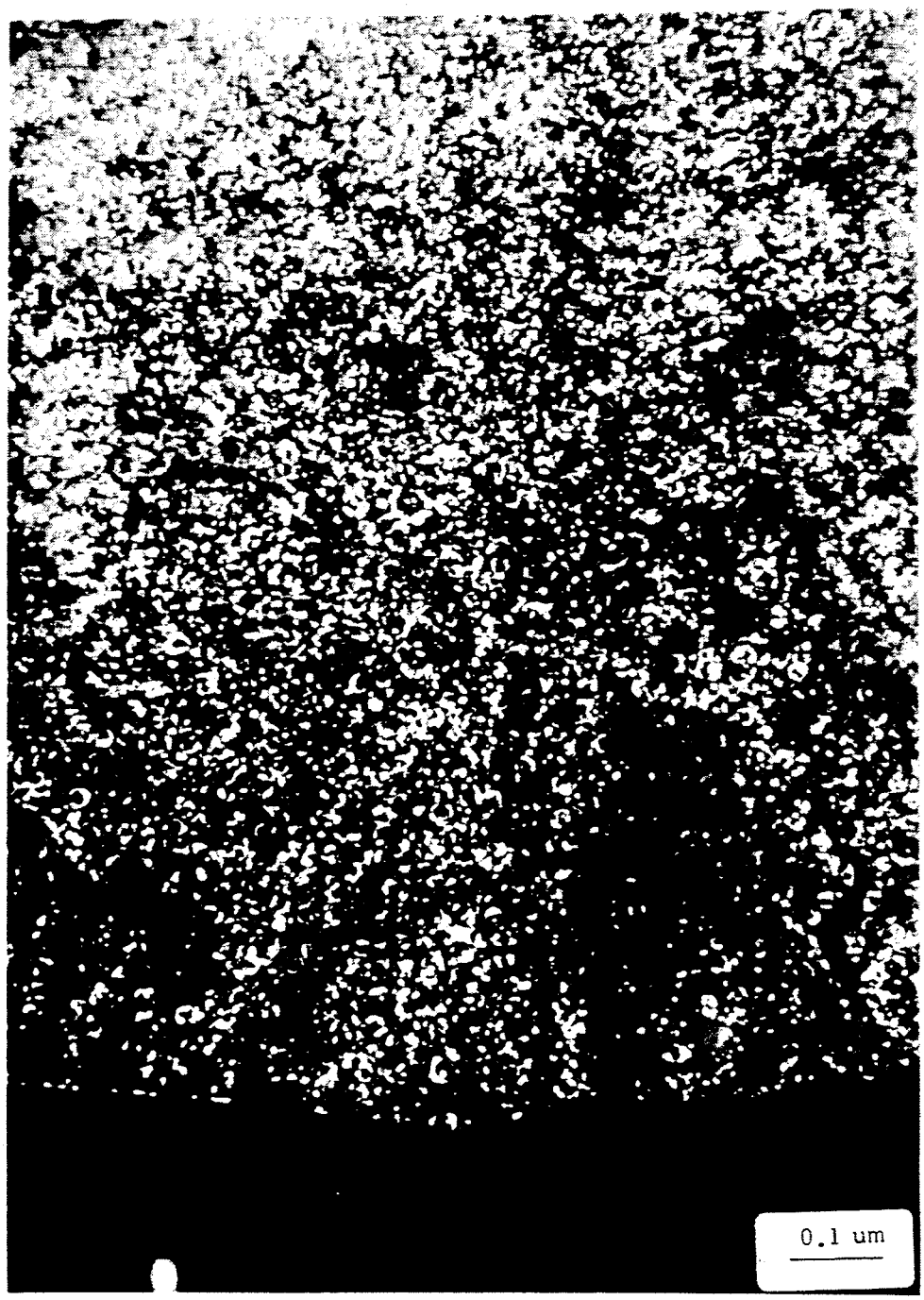
Figure 1C:
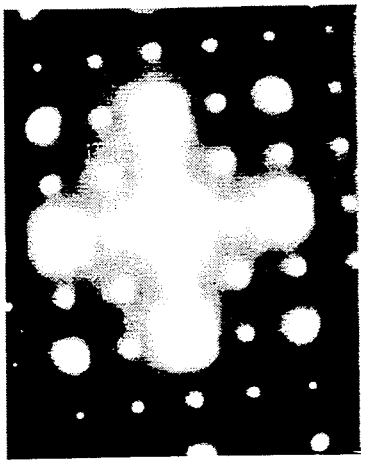
* and FIG. 1*c* shows the superlattice dark field TEM image of the article in FIG. 1*a.*

The consolidated article of the invention has a distinctive microstructure, as representatively shown in FIGS. 1*a* and 1*b*, which is composed of an aluminum solid solution containing therein a substantially uniform and highly dispersed distribution of intermetallic precipitates. These precipitates are essentially composed of fine $Al_3$(Zr,Li) containing Mg and Cu and measuring not more than about 5 nm along the largest linear dimension thereof.

The consolidated articles at about their peak aged condition have a tensile yield strength ranging from about 400 MPa (58 ksi) to 520 MPa (76 ksi), an ultimate tensile strength from about 480 MPa (70 ksi) to 600 MPa (87 ksi) with an elongation to fracture ranging from about 5 to 11% when measured at room temperature (20° C.). The consolidated articles also have a V-notch charpy impact energy in the L-T orientation ranging from about $4.6\times10^{-2}$ Joules/mm$^2$ to $8.0\times10^{-2}$ Joules/mm$^2$. In addition, the consolidated articles have a density less than 2.6 g/cm$^3$ and an elastic modulus of about $76\text{–}83\times10^6$ kPa ($11.0\text{–}12.0\times10^9$ psi).

The following examples are presented to provide a more complete understanding of the invention. The specific techniques, conditions, materials, proportions and reported data set forth to illustrate the principles and practice of the invention are exemplary and should not be construed as limiting the scope of the invention.

EXAMPLES 1-9

Alloys of the invention having compositions listed in Table I below have been prepared by rapid solidification in accordance with the method of the invention.

TABLE I

1. Al-2.1Li-1.0Cu-0.5Mg-0.6Zr

2. Al-2.6Li-1.0Cu-0.5Mg-0.4Zr
3. Al-2.6Li-1.0Cu-0.5Mg-0.6Zr
4. Al-2.6Li-1.0Cu-0.5Mg-0.8Zr
5. Al-2.6Li-1.0Cu-0.5Mg-1.0Zr
6. Al-2.6Li-1.0Cu-0.5Mg-1.4Zr
7. Al-2.6Li-1.0Cu-0.5Mg-1.6Zr
8. Al-3.4Li-1.0Cu-0.5Mg-0.6Zr
9. Al-2.6Li-0.8Cu-0.4Mg-0.6Zr

EXAMPLE 10

Alloys listed in Table II were formed into consolidated articles via extrusion in accordance with the method of the invention and exhibited the properties indicated in the Table. The consolidated articles were solutionized at 540° C. for 2 hrs. and quenched into an ice water bath; subsequently, they were aged at 135° C. for 16 hrs. and machined into round tensile specimens having a gauge diameter of ⅜" and a gauge length of ¾". Tensile testing was performed at room temperature at a strain rate of $5.5\times10^{-4}$ sec$^{-1}$. Notched charpy impact energies were measured on standard charpy specimens having a 0.001 inch notch radius. Both tensile and impact properties are from the L-T extrusion orientation.

TABLE II

| Composition (wt %) | 0.2% YS | UTS (MPa) (MPa) | Elong. to fract. (%) | V-Notch Impact Energy (Joules/mm$^2$) |
|---|---|---|---|---|
| Al-2.1Li-1.0Cu-0.5Mg-0.6Zr | 400 | 480 | 5.2 | $6.1\times10^{-2}$ |
| Al-2.6Li-1.0Cu-0.5Mg-0.4Zr | 410 | 520 | 5.3 | $5.5\times10^{-2}$ |
| Al-2.6Li-1.0Cu-0.5Mg-0.6Zr | 445 | 535 | 5.8 | $6.0\times10^{-2}$ |
| Al-2.6Li-1.0Cu-0.5Mg-0.8Zr | 470 | 550 | 5.5 | — |
| Al-2.6Li-1.0Cu-0.5Mg-1.0Zr | 480 | 555 | 8.7 | $4.9\times10^{-2}$ |
| Al-2.6Li-0.8Cu-0.4Mg-0.6Zr | 438 | 530 | 6.3 | $5.5\times10^{-2}$ |
| Al-3.4Li-1.0Cu-0.5Mg-0.6Zr | 470 | 570 | 6.5 | $2.8\times10^{-2}$ |

EXAMPLE 11

Alloys listed in Table III were formed into consolidated articles in accordance with the method of the invention and exhibited the densities indicated in the Table.

TABLE III

| Composition (wt %) | Density (g/cm$^3$) |
|---|---|
| Al-2.6Li-1.0Cu-0.5Mg-0.6Zr | 2.52 |
| Al-2.6Li-1.0Cu-0.5Mg-1.0Zr | 2.55 |
| Al-2.6Li-0.8Cu-0.4Mg-0.6Zr | 2.53 |
| Al-3.4Li-1.0Cu-0.5Mg-0.6Zr | 2.47 |
| Pure aluminum (ref) | 2.70 |

EXAMPLE 12

This example illustrates the age hardenable nature of these alloys and the inverse relationship between strength and V-notch impact energy. The tensile and impact properties of alloy Al-2.6Li-1.0Cu-0.5Mg-0.6Zr, consolidated in the aforementioned fashion by extrusion, are listed in Table IV. The consolidated articles were solutionized at 540° C. for 2 hrs. and quenched into an ice water bath; subsequently, they were aged at 135° C. for from 0 to 32 hrs. and machined into round tensile specimens having a gauge diameter of ⅜" and a gauge length of ¾". Tensile testing was performed at room temperature at a strain rate of $5.5\times10^{-4}$ sec$^{-1}$. Notched charpy impact energies were measured on standard charpy specimens having a 0.001 inch notch radius. Both tensile and impact properties are from the T-L extrusion orientation.

TABLE IV

| (Aging) Time (hours) | 0.2% Yield Strength (MPa) | Ultimate Tensile Strength (MPa) | Elong. to Fract. (%) | V-Notch Impact Energy (Joule/mm$^2$) (L-T orientation) |
|---|---|---|---|---|
| 0 | 260 | 400 | 14 | $>7.5\times10^{-2}$ |
| 1 | 370 | 485 | 10 | $3.1\times10^{-2}$ |
| 2 | 430 | 500 | 8 | $2.8\times10^{-2}$ |
| 4 | 410 | 500 | 8 | $1.9\times10^{-2}$ |
| 8 | 430 | 535 | 9 | $2.1\times10^{-2}$ |
| 16 | 440 | 540 | 7 | $1.5\times10^{-2}$ |
| 32 | 460 | 560 | 7 | $1.7\times10^{-2}$ |

EXAMPLE 13

This example illustrates the importance of zirconium in providing increased strength and increased ductility. The presence of zirconium in the amounts called for by the present invention controls the size distribution of the $Al_3(Li,Zr)$ phases, controls the subsequent aluminum matrix grain size, and controls the coarsening rate of other aluminum-rich intermetallic phases. The five alloys set forth in Table V, containing up to 1.0 wt % Zr, were cast into strip form, comminuted and consolidated via extrusion in the aforementioned manner of Example 10.

TABLE V

| Composition (wt %) | 0.2% YS (MPa) | UTS (MPa) | Elong. to fract. (%) | V-Notch Impact Energy (Joules/mm$^2$) (L-T orientation) |
|---|---|---|---|---|
| Al-2.6Li-1.0Cu-0.5Mg-0.2Zr | 360 | 470 | 4.5 | $6.7\times10^{-2}$ |
| Al-2.6Li-1.0Cu-0.5Mg-0.4Zr | 410 | 520 | 5.3 | $5.5\times10^{-2}$ |
| Al-2.6Li-1.0Cu-0.5Mg-0.6Zr | 445 | 535 | 5.8 | $6.0\times10^{-2}$ |
| Al-2.6Li-1.0Cu-0.5Mg-0.8Zr | 470 | 550 | 5.5 | — |
| Al-2.6Li-1.0Cu-0.5Mg-1.0Zr | 480 | 555 | 8.7 | $4.9\times10^{-2}$ |
| Al-2.6Li-0.8Cu-0.4Mg-0.6Zr | 438 | 530 | 6.3 | $5.5\times10^{-2}$ |
| Al-3.4Li-1.0Cu-0.5Mg-0.6Zr | 470 | 570 | 6.5 | $2.8\times10^{-2}$ |

EXAMPLE 14

This illustrates the effect of lithium on increasing strength at the expense of decreasing V-notch impact energy. The three alloys set forth in Table VI, containing up to 3.4 wt % Li, were cast into strip form, comminuted and consolidated via extrusion in the aforementioned manner of Example 10.

TABLE VI

| Composition (wt %) | 0.2% YS (MPa) | UTS (Mpa) | Elong. to fract. (%) | V-Notch Impact Energy (Joules/mm$^2$) (L-T orientation) |
|---|---|---|---|---|
| Al-2.1Li-1.0Cu-0.5Mg-0.6Zr | 400 | 480 | 5.2 | $6.1\times10^{-2}$ |
| Al-2.6Li-1.0Cu-0.5Mg-0.6Zr | 445 | 535 | 5.8 | $6.0\times10^{-2}$ |
| Al-3.4Li-1.0Cu-0.5Mg-0.6Zr | 470 | 580 | 6.0 | $2.3\times10^{-2}$ |

Having thus described the invention in rather full detail, it will be understood that such detail need not be strictly adhered to but that various changes and modifi-cations may suggest themselves to one skilled in the art, all falling within the scope of the invention as defined by the subjoined claims.

We claim:

1. A rapidly solidified, low density aluminum base alloy consisting essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt % and "d" ranges from about 0.4 to 1.8 wt %, the balance being aluminum.

2. An alloy as recited in claim 1, wherein "a" ranges from about 2.8 to 3.0 wt %, "b" ranges from about 0.8 to 1.2 wt %, "c" ranges from about 0.4 to 0.6 wt %, and "d" ranges from about 0.7 to 1.6 wt %.

3. A consolidated article as recited in claim 2, having a 0.2% tensile yield strength of 470 MPa, ultimate tensile strength of 550 MPa, tensile elongation to fracture of 5%, and a V-notch impact energy of $5.0\times10^{-2}$ Joules/mm$^2$.

4. An alloy as recited in claim 2, wherein "d" ranges from about 1.0 to 1.2 wt %.

5. A consolidated article as recited in claim 4, having a 0.2% tensile yield strength of 480 MPa, ultimate tensile strength of 555 MPa, tensile elongation to fracture of 8%, and a V-notch impact energy of $4.9\times10^{-2}$ Joules/mm$^2$.

6. A consolidated article produced in accordance with a method comprising the steps of:

a) compacting particles composed of a rapidly solidified, low density aluminum-base alloy consisting essentially of the formula $Al_{bal}Li_aCu_bMg_cZr_d$ wherein "a" ranges from about 2.1 to 3.4 wt %, "b" ranges from about 0.5 to 2.0 wt %, "c" ranges from about 0.2 to 2.0 wt % and "d" ranges from about 0.4 to 1.8 wt %, the balance being aluminum, said alloy having a primary cellular dendritic, fine-grain, supersaturated aluminum alloy solid solution phase with filamentary, intermetallic phases of the constituent elements dispersed therein, and said intermetallic phases having width dimension of not more than about 100 nm;

b) heating said alloy during said compacting step to a temperature of not more than about 500° C. to minimize coarsening of said intermetallic phases;

c) solutionizing said compacted alloy by heat treatment at a temperature ranging from about 500° C. to 550° C. for a period of approximately 0.5 to 5 hrs. to convert elements from micro-segregated and precipitated phases into said aluminum solid solution phase;

d) quenching said compacted alloy in a fluid bath; and e) aging said compacted alloy at a temperature ranging from about 100°-250° C. for a period ranging from 0 to 40 hrs.

7. A consolidated article as recited in claim 6 having a density of not more than 2.6 g/cm$^3$.

8. A consolidated article as recited in claim 6, having a 0.2% tensile yield strength of 440 MPa, ultimate tensile strength of 530 MPa, elongation to fracture of 5%, and a V-notch impact energy of $6.0\times10^{-2}$ Joules/mm$^2$.

* * * * *